US006783820B1

(12) United States Patent
Harada et al.

(10) Patent No.: US 6,783,820 B1
(45) Date of Patent: Aug. 31, 2004

(54) THERMAL TRANSFER RECORDING MEDIA

(75) Inventors: Toshimichi Harada, Tochigi (JP); Yoichi Shutara, Tochigi (JP)

(73) Assignee: Sony Chemicals, Corp., Tokyo (JP)

( * ) Notice: Subject to any disclaimer, the term of this patent is extended or adjusted under 35 U.S.C. 154(b) by 0 days.

(21) Appl. No.: 09/610,305

(22) Filed: Jul. 5, 2000

(30) Foreign Application Priority Data

Jul. 12, 1999 (JP) ..... 11-196876

(51) Int. Cl.[7] ..... B41M 5/30
(52) U.S. Cl. ..... 428/32.82; 428/32.8
(58) Field of Search ..... 428/32.82, 32.86, 428/195, 32.85

(56) References Cited

U.S. PATENT DOCUMENTS

| | | | | |
|---|---|---|---|---|
| 5,683,785 A | | 11/1997 | Talvalkar et al. | |
| 5,741,387 A | * | 4/1998 | Coleman | 156/240 |
| 5,837,382 A | * | 11/1998 | Hayashi et al. | 428/484 |
| 5,879,790 A | * | 3/1999 | Sogabe et al. | 428/213 |
| 5,880,065 A | * | 3/1999 | Hayashi et al. | 503/227 |
| 6,210,794 B1 | * | 4/2001 | Nakamura | 428/346 |

FOREIGN PATENT DOCUMENTS

| | | |
|---|---|---|
| EP | 0 841 188 A2 | 5/1998 |
| EP | 0 874 030 A2 | 10/1998 |
| JP | A-64-51981 | 2/1989 |
| JP | A-2-2076 | 1/1990 |
| JP | A 2-214693 | 8/1990 |
| JP | A-2-299885 | 12/1990 |
| JP | A 5-177954 | 7/1993 |
| JP | A-5-246159 | 9/1993 |
| JP | A 6-286336 | 10/1994 |
| JP | A 7-81254 | 3/1995 |
| JP | A-7-314931 | 12/1995 |
| JP | A 9-86056 | 3/1997 |
| JP | A-10-138643 | 5/1998 |
| JP | A 11-180044 | 7/1999 |

* cited by examiner

*Primary Examiner*—Bruce Hess
(74) *Attorney, Agent, or Firm*—Oliff & Berridge, PLC

(57) ABSTRACT

Thermal transfer recording media which make it possible to provide a highly sharpness and clear image even in case of printing on non-coated paper at a high speed and to improve the rub resistance of a printed area after the completion of printing.

The present invention provides a thermal transfer recording medium comprising of a base material and a peel layer including a wax (A) and an ink layer including a styrene resin (B), a binder component (C) and a coloring component (D) laminated successively on the base material, wherein the wax (A) is compatible with the styrene resin (B).

In the present invention, it is preferable that the weight ratio of the styrene resin (B) to the binder component (C) preferably ranges from 10:90 to 50:50.

4 Claims, 1 Drawing Sheet

1

101

THERMAL TRANSFER RECORDING MEDIA

FIELD OF THE INVENTION

This invention relates to thermal transfer recording media to be used for, e.g. thermal transfer printers.

BACKGROUND OF THE INVENTION

In the field of thermal transfer printers, edge head printers have been widely employed in these years.

These edge head printers have advantages of achieving a high printing speed (about 8 inch/sec) in spite of the simple structure thereof and being applicable to recording media having rough surface such as non-coated paper (so-called rough paper).

FIG. 2 shows an example of conventionally known thermal transfer recording media for these edge head printers.

In this thermal transfer recording medium 101 shown in FIG. 2, a peel layer 103 is formed on a base material 102 and a highly viscous ink layer 104 is further formed on the peel layer 103. On the other hand, a heat-resistant lubricating layer 105 is formed on the opposite face of the base material 102.

In recent years, printing speed has been more and more elevated (about 12 inch/sec). Therefore, it is impossible under the present conditions to obtain a clear image by printing on non-coated paper at a high speed.

In high-speed printing, there arises another problem that the resistance to rubbing (rub resistance) of the printed image is worsened.

The present invention, which has been completed to solve these problems encountering in the prior art, aims at providing thermal transfer recording media capable of providing a clear image in case of high-speed printing on non-coated paper and improving the rub resistance.

SUMMARY OF THE INVENTION

To achieve the object as described above, the present invention provides a thermal transfer recording medium comprising of a base material and a peel layer including a wax (A) and an ink layer including a styrene resin (B), a binder component (C) and a coloring component (D) laminated successively on the base material, wherein the wax (A) is compatible with the styrene resin (B).

The present inventor conducted studies on the transfer of a thermal transfer recording medium for non-coated paper. As a result, it has been found out that as the printing speed is elevated, no transfer occurs at the interface of the base material and the peel layer at the area to be peeled but peeling arises at the inner part of the peel layer. The peeling finally moves at the interface of the peel layer and the ink layer.

By using a peel layer including a wax (A) and an ink layer including a styrene resin (B) compatible with the wax (A), the peel layer sufficiently adheres to the ink layer even at the step of heat transfer. Thus, no peeling arises at the interface of the peel layer and the ink layer. The peel layer and the ink layer are transferred together from the base material, thereby ensuring smooth transfer of the ink layer and sufficient protection after the completion of printing.

According to the present invention, therefore, a clear image can be obtained and the rub resistance can be improved even in case of printing on non-coated paper at a high speed.

In the present invention, it is also effective to regulate the weight ratio of the styrene resin (B) to the binder component (C) to 10:90 to 50:50.

According to the present invention, the sharpness and rub resistance of a printed area can be improved.

When a binder component (C) including an ethylene-vinyl acetate copolymer is employed as in the present invention, the ink layer has a high viscosity and thus bleeding into non-coated paper can be prevented, thereby providing a clear image. In this case, moreover, a rubbery elasticity can be imparted to the ink layer and thus the rub resistance can be elevated.

In these figures, each numerical symbol has the following meaning:

1: thermal transfer recording medium

2: base material

3: peel layer

4: ink layer

5: heat-resistant lubricating layer.

DETAILED DESCRIPTION OF THE INVENTION

Next, embodiments of the thermal transfer recording medium according to the present invention will be described in greater detail by reference to the attached drawings.

Figure 1:
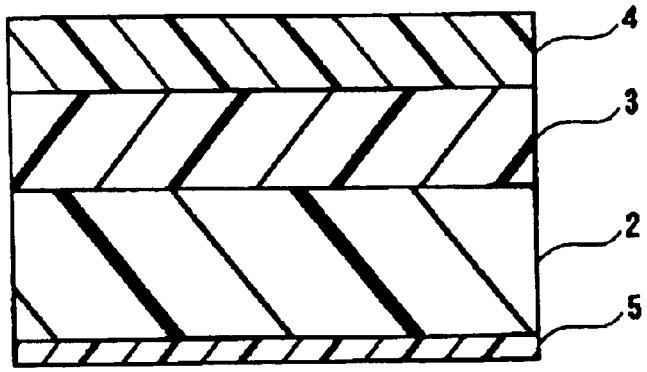
FIG. 1 is a sectional view showing the constitution of the thermal transfer recording medium according to the present invention.
Figure 2:
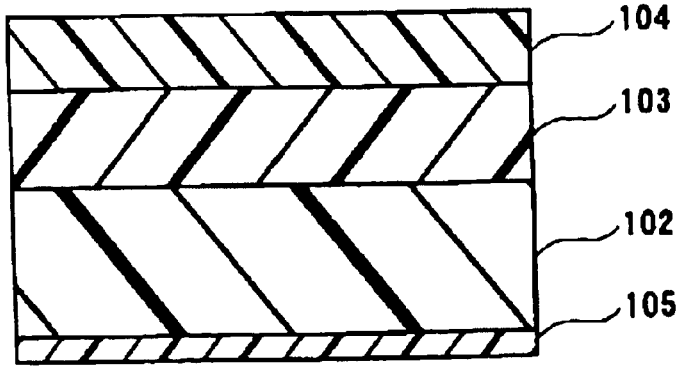
Fig.2 PRIOR ART
FIG. 2 is a sectional view showing the constitution of a conventional thermal transfer recording medium.

In the thermal transfer recording medium of the present invention, for example, a peel layer 3 and an ink layer 4 are successively formed on one face of a base material 2 as shown in FIG. 1. On the other face of the base material 2, a heat-resistant lubricating layer 5 is formed.

As the base material 2 to be employed in the present invention, use can be made of base materials employed in conventional thermal transfer recording media. For example, it is appropriate to use a base material made of paper such as condenser paper or parchment paper or a base material made of plastics such as a polyester film, a polyvinyl chloride film or a polycarbonate film.

From the viewpoints of the strength and heat transfer of the film, the thickness of this base material 2 preferably ranges from 2 to 15 $\mu$m, more preferably from 3 to 10 $\mu$m.

On the other hand, the function of the peel layer 3 is to improve the transfer properties of the ink layer 4 in the step of heat transfer. Under ordinary conditions (i.e., not in the step of heat transfer), the peel layer well adheres to the base material 2 and the ink layer 4 to thereby contribute to the prevention the ink layer 4 from scaling off.

The peel layer 3 of the present invention includes a wax (A).

Although the type of the wax (A) is not restricted in the present invention, it is preferable to use a wax having a melting point of from 50 to 90° C., more preferably from 65 to 75° C., from the viewpoint of improving the applicability to non-coated paper.

Examples of such a wax (A) include carnauba wax, candelilla wax, lanolin wax, rice wax and oxide wax.

Among these waxes, candelilla wax is particularly preferable from the viewpoint of improving the applicability to non-coated paper.

To prevent ink fall-out, it is also possible to add a thermoplastic elastomer such as polystyrene-polybutylene-polystyrene (SBS) to the above-described wax.

The thickness of the peel layer 3 may vary over a wide range by considering other factors, for example, the materials of other units such as the base material 2 and the ink layer 4 and the printing conditions. From the viewpoints of the printing energy, coating properties and printing qualities, the thickness of the peel layer preferably ranges from 0.3 to 2.0 $g/m^2$.

On the other hand, the ink layer 4 in the present invention includes a styrene resin (B), a binder component (C) and a coloring component (D).

In this case, a styrene resin (B) being compatible with the above-described wax (A) is used. The term "styrene resin" as used in the present invention involves both polymers and oligomers.

The term "compatible with" as used in the present invention means that the wax (A) and the styrene resin (B) do not separated from each other within a weight ratio range of 10:90 to 90:10, when they are molten together by heating at a temperature higher by 30° C. or more than the melting points of these components.

In the present invention, the weight ratio of the styrene resin (B) to the binder component (C) preferably ranges from 10:90 to 50:50, more preferably from 20:80 to 40:60.

When the weight ratio of the styrene resin (B) to the binder component (C) is leas than 10:90, there arises a problem that the rub resistance is worsened after printing. When the weight ratio exceeds 50:50, on the other hand, there arises another problem that the sharpness and rub resistance of a printed area are worsened particularly in case of high-speed printing.

It is preferable to use a binder component (C) having a melt index of from 3 to 1,000, more preferably from 60 to 400.

When the melt index of the binder component (C) is less than 3, there arises a problem that the sharpness of a printed area is worsened. When the melt index exceeds 1,000, there arises another problem that the applicability to non-coated paper is worsened.

As an example of such binder component (C), an ethylene-vinyl acetate copolymer (EVA) may be cited.

As the coloring component (D), on the other hand, use can be made of coloring components employed in conventional thermal transfer recording media. For example, carbon black and color pigments are appropriately usable therefor.

The heat-resistant lubricating layer 5 in the present invention is formed by using, for example, a publicly known silicone copolymer or silicone oil.

EXAMPLE

The thermal transfer recording media according to the present invention will be described in detail by reference to the following Examples and Comparative Examples.

Table 1 shows the properties of each component employed in Examples and Comparative Examples, while Table 2 summarizes the evaluation date of the samples of Examples and Comparative Examples.

TABLE 1 properties of each component

| | Product | Manufacturer | Melt Index |
|---|---|---|---|
| Binder component (C) (EVA) | K A31 | Sumitomo Chemical Co., Ltd. | 3 |
| | M B11 | Sumitomo Chemical Co., Ltd. | 60 |
| | K C10 | Sumitomo Chemical Co., Ltd. | 150 |
| | K E10 | Sumitomo Chemical Co., Ltd. | 300 |
| | Ultrasen725 | Tosoh Corporation | 1000 |
| | **Product** | **Manufacturer** | **Softening point (° C.)** |
| Styrene Resin (B) | FTR8100 | Mitsui Petrochemical Industries, Ltd. | 100 |
| | Kristalex 3100 | Rika-Hercules | 100 |
| | **Product** | **Manufacturer** | **M. p. (° C.)** |
| Wax (A) | Candelilla wax | Kato Yoko K.K. | 70 |
| | Carunaba wax | Kato Yoko K.K. | 83 |

TABLE 2

Evaluation data of Examples and Comparative examples

| | Ink layer | | | | 8 lps | | | 12 lps | | |
|---|---|---|---|---|---|---|---|---|---|---|
| | Component | | | Peel layer | Applicability to | | Rub | Applicability to non- | | Rub |
| | styrene resin (B) | Binder (C) | Ratio | component | non-coated paper | Sharpness | resistance | coated paper | Sharpness | resistance |
| Ex. 1 | FTR8100 | MB11 | 30/70 | Candalilla wax | ○ | ○ | ○ | ○ | ○ | ○ |
| C. Ex. 1 | — | MB11 | 0/100 | Candalilla wax | ○ | ○ | x | ○ | Δ | x |
| Ex. 2 | FTR8100 | KE10 | 30/70 | Candalilla wax | ○ | ○ | ○ | ○ | ○ | ○ |
| C. Ex. 2 | — | KE10 | 0/100 | Candalilla wax | ○ | ○ | x | ○ | ○ | x |
| Ex. 3 | FTR8100 | KC10 | 30/70 | Candalilla wax | ○ | ○ | ○ | ○ | ○ | ○ |
| C. Ex. 3 | — | KC10 | 0/100 | Candalilla wax | ○ | ○ | x | ○ | ○ | x |
| Ex. 4 | FTR8100 | KC10 | 10/90 | Candalilla wax | ○ | ○ | Δ | ○ | ○ | Δ |
| Ex. 5 | FTR8100 | KC10 | 50/50 | Candalilla wax | ○ | ○ | ○ | Δ | Δ | ○ |
| Ex. 6 | FTR8100 | KA31 | 30/70 | Candalilla wax | ○ | Δ | ○ | ○ | Δ | ○ |

TABLE 2-continued

Evaluation data of Examples and Comparative examples

| | Ink layer | | | | 8 lps | | | 12 lps | | |
|---|---|---|---|---|---|---|---|---|---|---|
| | Component | | | Peel layer | Applicability to | | Rub | Applicability to non- | | Rub |
| | styrene resin (B) | Binder (C) | Ratio | component | non-coated paper | Sharpness | resistance | coated paper | Sharpness | resistance |
| Ex. 7 | FTR8100 | Ultrasen 725 | 30/70 | Candalilla wax | ○ | ○ | ○ | Δ | ○ | ○ |
| Ex. 8 | FTR8100 | KC10 | 30/70 | Carunaba wax | ○ | ○ | ○ | Δ | ○ | ○ |
| C. Ex. 4 | Kristalex 3100 | KC10 | 30/70 | Candalilla wax | ○ | ○ | Δ | ○ | Δ | x |

EXAMPLE 1

(Preparation of Heat-resistant Lubricating Layer Composition)

5 parts by weight of an acrylic-silicone graft resin (US380 manufactured by Toagosei Chemical Industry, Co., Ltd.) was dissolved in 95 parts by weight of methyl ethyl ketone employed as a solvent to give the aimed heat resistant lubricating layer composition.

(Preparation of Peel Layer Forming Composition)

20 parts by weight of candelilla wax (Candelilla Wax manufactured by Kato Y ko K. K.) was dissolved in 80 parts by weight of toluene employed as a solvent to give the aimed peel layer-forming composition.

(Preparation of Ink Layer Forming Composition)

6 parts by weight of FTR8100 (manufactured by Mitsui Petrochemical Industries, Ltd.) employed as the styrene resin (B). 14 parts by weight of an EVA (MB11 manufactured by Sumitomo Chemical Co., Ltd.; melt Index: 60) employed as the binder component (C) and 6 parts by weight of carbon black (MONARCH120 manufactured by Cabot) employed as the coloring component (D) were dissolved under heating to 70° C. in 80 parts by weight of toluene employed as a solvent. Then the obtained solution was cooled while stirring with a stirrer to give the aimed ink layer forming composition.

In this Example, the weight ratio of the styrene resin (B) to the binder component (C) was 30:70.

(Formation of Thermal Transfer Recording Medium)

By using the heat-resistant lubricating layer composition as described above, a heat-resistant lubricating layer was formed by the gravure coating method on one face (the back side) of a polyethylene terephthalate (PET) film (F5 manufactured by Teijin Ltd.) of 5 μm in thickness and then the solvent was vaporized.

By using the peel layer forming composition as described above, a peel layer was next formed by the gravure coating method n the other face (the front side) of the above-described PET film and then the solvent was vaporized.

By using the ink layer forming dispersion as described above, an ink layer was further formed by the gravure coating method on the above-described peel layer and the solvent was vaporized. After curing at 50° C. for 168 hours, the aimed thermal transfer recording medium was obtained.

The heat-resistant lubricating layer had a thickness of 0.1 μm, the peel layer had a thickness of 1.5 μm and the ink layer had a thickness of 1.5 μm.

EXAMPLE 2

A thermal transfer recording medium was formed as in Example 1 but using another EVA (KE10 manufactured by Sumitomo Chemical Co., Ltd.; melt index: 300) as the binder component (C).

In this Example, the weight ratio of the styrene resin (B) to the binder component (C) was 30:70.

EXAMPLE 3

A thermal transfer recording medium was formed as in Example 1 but using another EVA (KC10 manufactured by Sumitomo Chemical Co., Ltd.; melt index: 150) an the binder component (C).

In this Example, the weight ratio of the styrene resin (B) to the binder component (C) was 30:70.

EXAMPLE 4

A thermal transfer recording medium was formed as in Example 3 but regulating the weight ratio of the styrene resin (B) to the binder component (C) to 10:90.

EXAMPLE 5

A thermal transfer recording medium was formed as in Example 3 but regulating the weight ratio of the styrene resin (B) to the binder component (C) to 50:50.

EXAMPLE 6

A thermal transfer recording medium was formed as in Example 1 but using another EVA (KA31 manufactured by Sumitomo Chemical Co., Ltd.; melt index: 3) as the binder component (C).

In this Example, the weight ratio of the styrene resin (B) to the binder component (C) was 30:70.

EXAMPLE 7

A thermal transfer recording medium was formed as in Example 1 but using another EVA (ULTRACEN 725 manufactured by Tosoh Corporation; melt index: 1000) as the binder component (C).

In this Example, the weight ratio of the styrene resin (B) to the binder component (C) was 30:70.

EXAMPLE 8

A thermal transfer recording medium was formed as in Example 3 but using carnauba wax (Carnauba Wax manufactured by Kato Yoko K. K.) as the wax (A).

In this Example, the weight ratio of the styrene resin (B) to the binder component (C) was 30:70.

Comparative Example 1

A thermal transfer recording medium was formned as in Example 1 but preparing the ink layer forming composition by using an EVA (MB11 manufactured by Sumitomo Chemical Co., Ltd.; melt index: 60) alone without blending any styrene resin (B).

Comparative Example 2

A thermal transfer recording medium was formed as in Example 1 but preparing the ink layer forming composition by using an EVA (KE10 manufactured by Sumitomo Chemical Co., Ltd.; melt index: 300) alone without blending any styrene resin (B).

Comparative Example 3

A thermal transfer recording medium was formed as in Example 1 but preparing the ink layer forming composition by using an EVA (KC10 manufactured by Sumitomo Chemical Co., Ltd.; melt index: 150) alone without blending any styrene resin (B).

Comparative Example 4

A thermal transfer recording medium was formed as in Example 3 but using a styrene resin (B) (Kristalex 3100 manufactured by Rika-Hercules) not compatible with the wax (A).

(Evaluation)

The thermal transfer recording media as described above were evaluated in the following items. Table 2 summarizes the results.

1. Applicability to Non-coated Paper

Applicability to non-coated paper was evaluated based on a bar code image printed on non-coated paper (Vellum, manufactured by Stielow) with HV50 (middle power) at a printing speed of 8 or 12 inch/sec with the use of a thermal transfer printer (Bar Code Printer TTX650 manufactured by AVERY). Table 2 shows the results.

In this Table, "○" stands for showing no missing print and "Δ" stands for showing some missing print but being usable in practice.

2. Sharpness

Sharpness of a printed area was evaluated based on a bar coda image printed on non-coated paper (Vellum, manufactured by Stielow) with the use of the above-described thermal transfer printer under the same conditions as defined above. Table 2 shows the results.

In this Table, "○" stands for showing neither cutout or dragging of the bar code image, and "Δ" stands for showing some cutout or dragging but being usable in practice.

3. Rub Resistance

By using a rubbing tester (AB301 Rubbing Tester manufactured by Tester Sangyo K. K.). a 200 g or 800 g spindle was slid back and forth 20 times on a coated paper piece (K8TB manufactured by TEC, 1 cm×1 cm) having been printed under the conditions as defined above. Then stains thus formed were evaluated with the naked eye. Table 2 summarizes the results.

In this Table, "○" stands for showing no cutout of the image, "Δ" stands for showing some cutout of the image but being usable in practice, and "x" stands for being impossible to read the image.

As Table 2 shows, the thermal transfer recording media of Examples 1 to 8 provided each clear printing qualities and sharp image sharpness even in case of printing on non-coated paper at the maximum printing speed (12 ips).

In contrast, the thermal transfer recording media of Comparative Examples 1 to 4 achieved each a pretty good applicability to non-coated paper but showed a very poor rub resistance in both of the cases of printing at 8 and 12 inch/sec.

As discussed above, the present invention makes it possible to provide a highly sharpness and clear image even in case of printing on non-coated paper at a high speed.

The present invention also makes it possible to improve the rub resistance of a printed area after the completion of printing.

What is claimed is:

1. A thermal transfer recording medium, comprising:

a base material in the form of a thin film;

a peel layer laminated on said base material and including a candelilla wax (A); and, an ink layer laminated on said peel layer and including a styrene resin (B), a binder component including ethylene-vinyl acetate copolymer (C) and a coloring component (D), wherein said wax (A) is compatible with said styrene resin (B) when within a weight ratio range of 10:90 to 90:10 of the wax and the styrene resin, respectively, and at a temperature at least 30° C. more than the melting points of the wax (A) and the styrene resin (B), and the weight ratio of the styrene resin (B) to the binder component (C) ranges from 10:90 to 50:50.

2. The thermal transfer recording medium as claimed in claim 1, wherein said wax (A) has a melting point of from 50 to 90° C.

3. The thermal transfer recording medium as claimed in claim 1, wherein said binder component (C) has a melt index of from 60 to 400.

4. The thermal transfer recording medium as claimed in claim 2, wherein said binder component (C) has a melt index of from 60 to 400.

* * * * *